US011370994B2

(12) United States Patent
Tate et al.

(10) Patent No.: US 11,370,994 B2
(45) Date of Patent: Jun. 28, 2022

(54) SURFACTANT BLEND COMPOSITIONS

(71) Applicant: Dow Global Technologies LLC, Midland, MI (US)

(72) Inventors: Michael P. Tate, Midland, MI (US); Jeffrey D. Michalowski, Midland, MI (US); Christopher J. Tucker, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 17/433,285

(22) PCT Filed: Apr. 21, 2020

(86) PCT No.: PCT/US2020/029102

§ 371 (c)(1),
(2) Date: Aug. 24, 2021

(87) PCT Pub. No.: WO2020/231606

PCT Pub. Date: Nov. 19, 2020

(65) Prior Publication Data

US 2022/0135905 A1 May 5, 2022

Related U.S. Application Data

(60) Provisional application No. 62/845,952, filed on May 10, 2019.

(51) Int. Cl.

| | |
|---|---|
| ***C11D 1/72*** | (2006.01) |
| ***C11D 1/825*** | (2006.01) |
| ***C11D 3/37*** | (2006.01) |

(52) U.S. Cl.
CPC ..... *C11D 1/825* (2013.01); *C11D 3/3707* (2013.01); *C11D 1/72* (2013.01)

(58) Field of Classification Search
CPC ..... C11D 1/72; C11D 1/825; C11D 3/2041; C11D 3/3707
See application file for complete search history.

(56) References Cited

U.S. PATENT DOCUMENTS

| | | | | |
|---|---|---|---|---|
| 4,396,522 | A | 8/1983 | Callicott et al. | |
| 4,861,518 | A | 8/1989 | Morganson et al. | |
| 5,436,008 | A | 7/1995 | Richter et al. | |
| 6,387,870 | B1 | 5/2002 | Klaers et al. | |
| 2001/0014658 | A1* | 8/2001 | Smith | C11D 1/722 510/421 |
| 2002/0198133 | A1 | 12/2002 | Behler et al. | |
| 2015/0094251 | A1 | 4/2015 | Rees et al. | |

FOREIGN PATENT DOCUMENTS

| | | |
|---|---|---|
| EP | 0522365 | 1/1993 |
| WO | 199823712 A2 | 6/1998 |

OTHER PUBLICATIONS

Mahlin, "Influence of polymer molecular weight on the solid-state structure of PEG/monoolein mixtures" Polymer, 2005, pp. 12210-12217.

* cited by examiner

*Primary Examiner* — Brian P Mruk
(74) *Attorney, Agent, or Firm* — Mark A. Twilley

(57) ABSTRACT

A composition comprising a surfactant blend, comprising: a polyethylene glycol, wherein the polyethylene glycol has an average molecular weight of from 5,000 g/mol to 9,000 g/mol; a first ethoxylated alcohol comprising the formula R—O(EO)$_n$—H, where R is an alkyl, alkenyl, aryl, aralkyl, or heterocyclic group having 7-25 carbons, where (EO) is a polyoxyethylene chain and where n is from 3 to 9, wherein the first ethoxylated alcohol has a Pour Point below 23° C.; and a second ethoxylated alcohol comprising the formula R—O(EO)$_m$—H, where R is an alkyl, alkenyl, aryl, aralkyl, or heterocyclic group having 7-25 carbons, where (EO) is a polyoxyethylene chain and where m is from 12 to 20, wherein the second ethoxylated alcohol has a Pour Point at or above 23° C., further wherein the first ethoxylated alcohol is from 20 wt % to 80 wt % of a total weight of the surfactant blend.

9 Claims, No Drawings

SURFACTANT BLEND COMPOSITIONS

BACKGROUND

Field of the Invention

The present disclosure generally relates to surfactant blends, and more specifically, to surfactant blend compositions and the associated methods of manufacturing the surfactant blends.

INTRODUCTION

Cleaning products typically include one or more surfactants to enhance the cleaning performance of the cleaning product. Liquid surfactants offer a variety of beneficial cleaning characteristics when used in cleaning products. For example, liquid surfactants dissolved in water exhibit greater cleaning performance and wettability of surfaces than do solid surfactants when dissolved in water. Cleaning products incorporating liquid surfactants are typically produced and sold as liquid concentrates. However, liquid concentrate cleaning products present difficulties during processing, shipping, storage and use based on the fluid nature of the liquid concentrate. Solid cleaning products are typically easier to process, ship, store and use than liquid concentrate cleaning products because of the lack of fluid characteristics exhibited by the solid cleaning product. As such, invention of solid cleaning products which are incorporate a liquid surfactant would be advantageous.

Conventional approaches to creating solid form cleaning products are limited in the amount of liquid surfactant that may be incorporated. As the concentration of the liquid surfactant increases within the cleaning component, solid components of the cleaning composition become diluted in the liquid surfactant. As such, a firmness of the cleaning product decreases with increasing liquid surfactant concentration until the cleaning product can no longer be considered a solid. Consistent with this understanding, U.S. Pat. No. 4,861,518A discloses a solid floor cleaner which specifically limits liquid ethoxylated alcohol surfactants to a preferable concentration of 10 wt % to 14 wt %.

As such, the discovery of a cleaning product which has 20 wt % or greater of a liquid surfactant present and exhibits a firmness sufficient to render the cleaning product a solid would be surprising.

BRIEF SUMMARY OF THE INVENTION

The present invention is a surfactant blend which comprises 20 wt % to 80 wt % liquid surfactant and exhibits a firmness of 275 g or more at 23° C.

The present invention is a result of discovering that an ethoxylated alcohol has a Pour Point at 23° C. or greater may be used with an ethoxylated alcohol that has a Pour Point below 23° C. in a surfactant blend comprising polyethylene glycol to form a self-organized micelle structure in the surfactant blend. The surfactant blend of ethoxylated alcohols in conjunction with polyethylene glycol exhibits a surprising result of increasing the firmness of the surfactant blend with an increasing liquid surfactant addition over a certain weight percentage range.

The present disclosure is particularly useful in the formation and processing of solid cleaning products.

The present invention is a composition comprising a surfactant blend, comprising: a polyethylene glycol, wherein the polyethylene glycol has an average molecular weight of from 5,000 g/mol to 9,000 g/mol; a first ethoxylated alcohol comprising the formula R—O(EO)$_n$—H, where R is an alkyl, alkenyl, aryl, aralkyl, or heterocyclic group having 7-25 carbons, where (EO) is a polyoxyethylene chain and where n is from 3 to 9, wherein the first ethoxylated alcohol has a Pour Point below 23° C.; and a second ethoxylated alcohol comprising the formula R—O(EO)$_m$—H, where R is an alkyl, alkenyl, aryl, aralkyl, or heterocyclic group having 7-25 carbons, where (EO) is a polyoxyethylene chain and where m is from 12 to 20, wherein the second ethoxylated alcohol has a Pour Point at or above 23° C., further wherein the first ethoxylated alcohol is from 20 wt % to 80 wt % of a total weight of the surfactant blend.

DETAILED DESCRIPTION

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

All ranges include endpoints unless otherwise stated. Subscript values in polymer formulae refer to mole average values for the designated component in the polymer.

Test methods refer to the most recent test method as of the priority date of this document unless a date is indicated with the test method number as a hyphenated two-digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

As used herein, the term "liquid" in reference to an ethoxylated alcohol refers to an ethoxylated alcohol which has a Pour Point of less than 23° C. As used herein, the term "solid" in reference to an ethoxylated alcohol refers to an ethoxylated alcohol which has a Pour Point at 23° C. or greater. The Pour Point of a liquid is the temperature below which the liquid loses its flow characteristics. Pour Point is determined according to the American Society for Testing and Materials (ASTM) standard D97.

As used herein, the term "average molecular weight" is the number average molecular weight and is tested using a hydroxyl number analysis as described by ASTM standard D4274.

As used herein, a "wt %" or "weight percent" or "percent by weight" of a component, unless specifically stated to the contrary, is based on the total weight of the composition or article in which the component is included. As used herein, all percentages are by weight unless indicated otherwise.

Surfactant Blend

The present invention comprises a surfactant blend which comprises polyethylene glycol, a first ethoxylated alcohol and a second ethoxylated alcohol. Based on the proportions of the polyethylene glycol, the first ethoxylated alcohol, and the second ethoxylated alcohol, the surfactant blend advantageously exhibits a firmness of 273 g or greater at 23° C. as determined by Firmness Testing as explained in the Examples section. It will be understood that one or more flow aids (e.g., fumed silica) and inert components (e.g., polymers, preservatives, dyes & markers, water, etc.) may be included to improve one or more characteristics of the surfactant blend without departing from the teachings provided herein. The surfactant blend may comprise 10 wt % or less, or 5 wt % or less, or 2 wt % or less or 1 wt % or less of an additional hardening agent or may be free of an additional hardening agent.

Polyethylene Glycol

The surfactant blend comprises polyethylene glycol. Polyethylene glycol refers to an oligomer or polymer of ethylene oxide represented by the formula $H—(O—CH_2—CH_2)_q—OH$, where q refers to the number of repeat units in the polyethylene glycol polymer. The q value for the polyethylene glycol may be in a range from 68 to 250.

The average molecular weight of the polyethylene glycol may be 3,000 g/mol or more, or 3,500 g/mol or more, or 4,000 g/mol or more, or 4,500 g/mol or more, or 5,000 g/mol or more, or 5,500 g/mol or more, or 6,000 g/mol or more, or 6,500 g/mol or more, or 7,000 g/mol or more, or 7,500 g/mol or more, or 8,000 g/mol or more, or 8,500 g/mol or more, or 9,000 g/mol or more, or 9,500 g/mol or more, or 10,000 g/mol or more, or 10,500 g/mol or more, or 11,000 g/mol or more, while at the same time, 11,000 g/mol or less, or 10,500 g/mol or less, or 10,000 g/mol or less, or 9,500 g/mol or less, or 9,000 g/mol or less, or 8,500 g/mol or less, or 8,000 g/mol or less, or 7,500 g/mol or less, or 7,000 g/mol or less, or 6,500 g/mol or less, or 6,000 g/mol or less, or 5,500 g/mol or less, or 5,000 g/mol or less, or 4,500 g/mol or less, or 4,000 g/mol or less, or 3,500 g/mol or less, or 3,000 g/mol or less. For example, the average molecular weight of the polyethylene glycol may be from 3,000 g/mol to 11,000 g/mol, or from 4,000 g/mol to 10,000 g/mol, or from 5,000 g/mol to 9,000 g/mol, or from 6,000 g/mol to 9,000 g/mol, or from 7,000 g/mol to 9,000 g/mol. A blend of different average molecular weight polyethylene glycols, at the same or different weight percent, may be utilized in the surfactant blend.

The polyethylene glycol may be from 10 wt % to 50 wt % of the surfactant blend. The surfactant blend may comprise the polyethylene glycol at 10 wt % or more, or 12 wt % or more, or 14 wt % or more, or 16 wt % or more, or 18 wt % or more, or 20 wt % or more, or 25 wt % or more, or 30 wt % or more, or 35 wt % or more, or 40 wt % or more, or 45 wt % or more, or 50 wt % or more, while at the same time, 50 wt % or less, or 45 wt % or less, or 40 wt % or less, or 35 wt % or less, or 30 wt % or less, or 25 wt % or less, or 20 wt % or less, or 15 wt % or less, or 10 wt % or less. For example, the surfactant blend may comprise from 10 wt % to 60 wt % polyethylene glycol, or from 20 wt % to 50 wt % polyethylene glycol, or from 20 wt % to 40 wt % polyethylene glycol, or from 20 wt % to 30 wt % polyethylene glycol.

Ethoxylated Alcohols

The surfactant blend comprises two or more ethoxylated alcohols. The surfactant blend comprises the first ethoxylated alcohol and the second ethoxylated alcohol. The surfactant blend may comprise an additional ethoxylated alcohol beyond the first and second ethoxylated alcohols. The first ethoxylated alcohol has the formula $R—O(EO)_n—H$ and the second ethoxylated alcohol has the formula $R—O(EO)_m—H$, where R is independently in each occurrence selected from the group consisting of an alkyl, an alkenyl, an aryl, an aralkyl, and heterocyclic groups having 7-25 carbons, and (EO) is a polyoxyethylene chain with the subscript n or m representing the average number of oxyethylene units. As defined herein, the subscripted n and m values are tested and determined by Proton Nuclear Magnetic Resonance Spectroscopy and Carbon-13 Nuclear Magnetic Resonance Spectroscopy.

Subscript n of the first ethoxylated alcohol can be 3 or more, 4 or more, 5 or more, 6 or more, 7 or more, 8 or more, or 9 or more, while at the same time, 9 or less, 8 or less, 7 or less, 6 or less, 5 or less, 4 or less, or 3 or less. For example, subscript n can be from 3 to 9, or from 4 to 9, or from 5 to 9, or from 6 to 9, or from 7 to 9. The subscript m of the second ethoxylated alcohol can be 12 or more, 13 or more, 14 or more, 15 or more, 16 or more, 17 or more, 18 or more, 19 or more, or 20 or more, while at the same time, 20 or less, 19 or less, 18 or less, 17 or less, 16 or less, 15 or less, 14 or less, 13 or less, or 12 or less. For example, subscripted m can be from 12 to 20, or from 13 to 20, or from 14 to 20, or from 15 to 20, or from 16 to 20, or from 17 to 20, or from 18 to 20.

The first and second ethoxylated alcohols utilized in the surfactant blend are different phases at 23° C. than one another. For example, one or more of the ethoxylated alcohols may be a solid at 23° C. while one or more of the ethoxylated alcohols may be a liquid at 23° C. It will be understood that the foregoing and forthcoming description is in relation to "neat" or substantially pure ethoxylated alcohols.

The first ethoxylated alcohol is a liquid at 23° C. and as such the Pour Point of the first ethoxylated alcohol is 22° C. or less. The Pour Point of the first ethoxylated alcohol can be 22° C. or less, 20° C. or less, 15° C. or less, 10° C. or less, 9° C. or less, 6° C. or less, 5° C. or less, 4° C. or less, 3° C. or less, 2° C. or less, −5° C. or less, −8° C. or less, −10° C. or less, −15° C. or less, −20° C. or less, −25° C. or less, −30° C. or less, −35° C. or less, −40° C. or less, −45° C. or less, −50° C. or less, while at the same time, −50° C. or more, −45° C. or more, −40° C. or more, −35° C. or more, −30° C. or more, −25° C. or more, −20° C. or more, −15° C. or more, −10° C. or more, −8° C. or more, −5° C. or more, 2° C. or more, 3° C. or more, 4° C. or more, 5° C. or more, 6° C. or more, 9° C. or more, 10° C. or more, 15° C. or more, 20° C. or more. For example, the Pour Point of the first ethoxylated alcohol may be from −50° C. to 22° C., or from −50° C. to 0° C., or from −25° C. to 22° C., or from −25° C. to 0° C., or from 0° C. to 22° C., or from −10° C. to 10° C.

The second ethoxylated alcohol is a solid at 23° C. and as such the Pour Point of the second ethoxylated alcohol is 23° C. or more. The Pour Point of the second ethoxylated alcohol can be 23° C. or more, 24° C. or more, 25° C. or more, 26° C. or more, 27° C. or more, 28° C. or more, 29° C. or more, 30° C. or more, 31° C. or more, 32° C. or more, 33° C. or more, 34° C. or more, 35° C. or more, 36° C. or more, 37° C. or more, 38° C. or more, 39° C. or more, 40° C. or more, 41° C. or more, 42° C. or more, 43° C. or more, 44° C. or more, 45° C. or more, 46° C. or more, 47° C. or more, 48° C. or more, 49° C. or more, 50° C. or more, while at the same time, 50° C. or less, 49° C. or less, 48° C. or less, 47° C. or less, 46° C. or less, 45° C. or less, 44° C. or less, 43° C. or less, 42° C. or less, 41° C. or less, 40° C. or less, 39° C. or less, 38° C. or less, 37° C. or less, 36° C. or less, 35° C. or less, 34° C. or less, 33° C. or less, 32° C. or less, 31° C. or less, 30° C. or less, 29° C. or less, 28° C. or less, 27° C. or less, 26° C. or less, 25° C. or less, 24° C. or less. For example, the Pour Point of the second ethoxylated alcohol may be from 23° C. to 50° C., or from 23° C. to 40° C., or from 30° C. to 50° C.

The first ethoxylated alcohol may be from 20 wt % to 80 wt % of the surfactant blend. The first ethoxylated alcohol may be present in the surfactant blend at 20 wt % or more, 25 wt % or more, 30 wt % or more, 35 wt % or more, 40 wt % or more, 45 wt % or more, 50 wt % or more, 55 wt % or more, 60 wt % or more, 65 wt % or more, 70 wt % or more, 75 wt % or more, or 80 wt % or more, while at the same time, 80 wt % or less, 75 wt % or less, 70 wt % or less, 65 wt % or less, 60 wt % or less, 55 wt % or less, 50 wt % or less, 45 wt % or less, 40 wt % or less, 35 wt % or less, 30 wt % or less, 25 wt % or less, 20 wt % or less. For example, the surfactant blend may comprise from 20 wt % to 80 wt %, or from 30 wt % to 70 wt %, or from 20 wt % to 65 wt %, or from 40 wt % to 60 wt % of the first ethoxylated alcohol.

The second ethoxylated alcohol may be from 20 wt % to 60 wt % of a total weight of the surfactant blend. The second ethoxylated alcohol may be present in the surfactant blend at 20 wt % or more, 25 wt % or more, 30 wt % or more, 35 wt % or more, 40 wt % or more, 45 wt % or more, 50 wt % or more, 55 wt % or more, 60 wt % or more, while at the same time, 60 wt % or less, 55 wt % or less, 50 wt % or less, 45 wt % or less, 40 wt % or less, 35 wt % or less, 30 wt % or less, 25 wt % or less, 20 wt % or less. For example, the surfactant blend may comprise from 20 wt % to 60 wt %, or from 20 wt % to 40 wt %, or from 40 wt % to 60 wt % of the second ethoxylated alcohol.

The surfactant blend comprises a relatively high weight fraction of the combined first and second ethoxylated alcohols as compared to the polyethylene glycol and optional fillers. Relative to the total weight of the surfactant blend, the combined first and second ethoxylated alcohols may account for 40 wt % or more, 45 wt % or more, 50 wt % or more, 55 wt % or more, 60 wt % or more, 65 wt % or more, 70 wt % or more, 75 wt % or more, 80 wt % or more, 85 wt % or more, while at the same time, 90 wt % or less, 85 wt % or less, 80 wt % or less, 75 wt % or less, 70 wt % or less, 65 wt % or less, 60 wt % or less, 55 wt % or less, 50 wt % or less, 45 wt % or less, 40 wt % or less, 35 wt % or less. For example, the first and second ethoxylated alcohols may account for 40 wt % to 90 wt %, or from 40 wt % to 80 wt %, or from 50 wt % to 70 wt % of the total weight of the surfactant blend. Such a feature may be advantageous in limiting the non-active ingredients present in the surfactant blend thereby increasing the efficacy of the surfactant blend.

Mixing of the Ethoxylated Alcohols

Conventional approaches to the formation of solid detergents utilizing a liquid surfactant have typically resulted in one of two outcomes: (1) the resulting detergent was soft at 23° C. owing to the incorporation of the liquid surfactant and/or; (2) the resulting detergent was present in a limited concentration to keep the detergent firm. The inventors of the present invention have discovered that the mixing of a liquid ethoxylated alcohol, a solid ethoxylated alcohol and propylene glycol yields a surfactant blend which surprisingly exhibits increasing firmness with increasing liquid surfactant weight percentage over certain ranges. Such a result is counterintuitive as increasing the proportion of a liquids into solids typically results in decreased firmness due to solids separation and/or the formation of a biphasic system.

Without being bound by theory, the incorporation of the first, liquid, ethoxylated alcohol with the second, solid, ethoxylated alcohol and the polyethylene glycol results in a formation of a self-organized solid dispersion system. The solid dispersion system stabilizes the liquid first ethoxylated alcohol within the second ethoxylated alcohol and the polyethylene glycol at and above 23° C. In other words, the surfactant blend exhibits a firmness, stability, viscosity, processability (e.g., the ability to be formed into powders, flakes, granules, and/or pellets) and other characteristics of solidity at and greater than 23° C. By adjusting the composition of the first and second ethoxylated alcohols, the surfactant blend may exhibit increased solid properties (e.g., firmness) with an increasing weight percentage of the first, liquid, ethoxylated alcohol.

The firmness of the surfactant blend changes with the changing concentration of the first ethoxylated alcohol in a surprising manner. For certain compositions of the first and second ethoxylated alcohols, when the concentration of the first ethoxylated alcohol is less than 20% of the total weight of the surfactant blend, the firmness of the surfactant blend expectedly decreases with increasing first ethoxylated alcohol addition. Surprisingly, as the first ethoxylated alcohol reaches relatively 20 wt % or more, the firmness of the surfactant blend gradually increases to a peak firmness before the firmness begins to drop with increasing concentration of the first ethoxylated alcohol. Without being bound by theory, the relative concentrations of the first and second ethoxylated alcohols change the stability of the first ethoxylated alcohol in the surfactant blend leading to a range of firmness values exhibited by the surfactant blend. Typically observed is a curve of increasing firmness ("firmness curve") of the surfactant blend with increasing wt % of first ethoxylate alcohol until a maximum or peak firmness is achieved, followed by a reduction of the firmness values.

The firmness of the surfactant blend is provided in units of grams (g) and is measured by Firmness Testing as explained in the Examples section. The surfactant blend exhibits a firmness of 200 g or more, 225 g or more, 250 g or more, 275 g or more, 300 g or more, 325 g or more, 350 g or more, 375 g or more, 400 g or more, 425 g or more, 450 g or more, 475 g or more, 500 g or more, 525 g or more, 550 g or more, 575 g or more, 600 g or more, 625 g or more, 650 g or more, while at the same time, 650 g or less, 625 g or less, 600 g or less, 575 g or less, 550 g or less, 525 g or less, 500 g or less, 475 g or less, 450 g or less, 425 g or less, 400 g or less, 375 g or less, 350 g or less, 325 g or less, 300 g or less, 275 g or less, 250 g or less, 225 g or less, 200 g or less. For example, the surfactant blend may exhibit a firmness in the range of from 200 g to 650 g, or from 300 g to 600 g, or from 350 g to 600 g, or from 400 g to 550 g.

Through mixing of the first ethoxylated alcohol, the second ethoxylated alcohol and the polyethylene glycol to form the surfactant blend, the surfactant blend may exhibit a softening temperature which is above 23° C. As the surfactant blend is a mixture of various molecular weight components, the surfactant blend may exhibit an onset softening temperature and a maximum softening temperature. The onset softening temperature is the temperature at which the surfactant blend begins transitioning to liquid as visually observed. The maximum softening temperature of the surfactant blend is the temperature at which the majority by volume of the components of the surfactant blend are transitioning from solid to liquid. The onset softening temperature or the maximum softening temperature of the surfactant blend may be 50° C. or more, 51° C. or more, 52° C. or more, 53° C. or more, 54° C. or more, 55° C. or more, 56° C. or more, 57° C. or more, 58° C. or more, 59° C. or more, 60° C. or more.

Although the surfactant blend will exhibit a "peak," or maximum, firmness achieved with increasing first (liquid) ethoxylated alcohol, such peak firmness may not be necessary to utilize the surfactant blend. For example, mixtures of the polyethylene glycol, the first ethoxylated alcohol and the second ethoxylated alcohol that do not achieve maximum firmness may still provide sufficient firmness and various other desirable properties such as hydrophobic-lipophilic balance, cloud point, critical micelle concentration and/or other properties related to the performance of the surfactant blend. As such, a given surfactant blend may not be at peak firmness yet still exhibit sufficient firmness to be considered a solid and offer desirable surfactant properties.

The surfactant blend can be prepared by heating the first ethoxylated alcohol, the second ethoxylated alcohol and the polyethylene glycol to a molten mixture with a minimum temperature of 60° C. (and an upper temperature defined by charring of the components). The molten mixture may be formed in an extruder, a heated & stirred tank, or other similar heated structures. The molten mixture is mixed for a given period of time (e.g., from about 30 minutes to 2 hours) and then solidifies upon cooling. Solidification may be accomplished through either active cooling or passive cooling.

After formation of the solid surfactant blend, the surfactant blend may be processed into small piece through spray drying, prilling, extrusion with a pelletizer and/or by other methods. The resulting surfactant blend may be in the form of a powder, flakes, granules, pellets or other form factors.

The surfactant blend may be included in a formulated cleaning composition. For example, the formulated cleaning composition may include the surfactant blend which is combined, blended or otherwise mixed with other solid and/or liquid additives (e.g., fragrances, dyes, coloring, flow aids, detergents) to create the formulated cleaning composition. A method of forming the cleaning composition may include steps of:

1) forming a surfactant blend comprising a polyethylene glycol, a first ethoxylated alcohol having a Pour Point below 23° C. and a second ethoxylated alcohol having a Pour Point at or above 23° C., wherein the surfactant blend has a firmness of 250 g or greater; and 2) mixing the surfactant blend with one or more solid and/or liquid additives to form the cleaning composition. The additives may include a fragrance, a surfactant, a caustic (e.g., NaOH, KOH, etc.), a flow aid, other cleaning product components and/or combinations thereof.

In use of the formulated cleaning composition, or the surfactant blend on its own, water or other polar solvents may be applied (e.g., by immersion and/or by surface contact) resulting in dissolution of the cleaning product or the surfactant blend which yields the water-soluble polyethylene glycol and the first and second ethoxylated alcohols. The first and second ethoxylated alcohols may subsequently act as a detergent and/or wetting agent.

Use of the present disclosure may offer a variety of advantages. First, mixture of the polyethylene glycol, the first ethoxylated alcohol and the second ethoxylated alcohol allows for the handling of concentrated liquid surfactant as a solid. Conventional approaches of incorporating liquid surfactants into detergent blends either must be performed at a sufficiently low temperature to gel the surfactant or such high quantities of hardening agent must be added that the detergent contains less than 20 wt % surfactant. By forming a solid dispersion of the liquid first ethoxylated alcohol with the second ethoxylated alcohol and the polyethylene glycol, the ingredients of the surfactant blend may be mixed and/or stored at or above 23° C. as well as contain 20 wt % or greater surfactant.

Second, the solid form factor of the surfactant blend allows for the surfactant blend to be incorporated into a variety of solid cleaning products. Conventional detergents which incorporate liquid surfactants often suffer from the detergents gelling or separating during storage or shipping which may result in inhomogeneous or deteriorated performance. By utilizing the surfactant blend in a solid form, the surfactant blend may be combined with a variety of other solid materials to result in a solid cleaning product (e.g., laundry detergents, degreasers, all-purpose cleaners, glass cleaners, etc.) at 23° C. and above.

Third, a wide range of weight percentages of the liquid first ethoxylated alcohol may be utilized to form the solid surfactant blend. Often, solid dispersions may suffer from the need for precise mixtures of ingredients in order for self-assembly to initiate. The broad range of acceptable weight percentages of the liquid first ethoxylated alcohol which allows for the formation enables tailoring of the desirable properties such as hydrophobic-lipophilic balance, cloud point, critical micelle concentration while producing a solid surfactant blend.

EXAMPLES

Unless otherwise specified, Firmness Testing was done to determine firmness measurements and was performed on a 3.81 centimeter (cm) diameter solid puck. The solid pucks were prepared using a carver press with 13.8 megapascals (MPa) applied by hand. The firmness measurements were performed using Texture Technologies' TA.XT Plus texture analyzer with a 5 millimeter (mm) spherical probe attached. For firmness testing, the firmness values were recorded in grams which were required to travel 3 mm at 1 mm/second into the solid puck. The maximum grams measured over that distance was recorded as the firmness value. The reported firmness values of the following tables are the average of five separate measurements of the same puck.

Examples 1-35 are detergents (e.g., the surfactant blend) consistent with the present disclosure which include a liquid surfactant (e.g., the first ethoxylated alcohol), a solid surfactant (e.g., the second ethoxylated alcohol) and polyethylene glycol. Examples were prepared using the following procedure. The specified weight percent of the liquid surfactant and the solid surfactant were added with a specified weight percent of the polyethylene glycol to form a blend. The polyethylene glycol of each Example had a number average molecular weight of 8,000 g/mol (available from Dow Chemical as CARBOWAX™ Polyethylene Glycol (PEG) 8000). The blend was heated to 70° C. The blends were then mixed using an overhead mixer at 100 revolutions per minute and allowed to fully mix for 30 minutes. The mixing was immediately ceased, and the blend allowed to cool to 23° C. In the following tables, EO5 represents $C_{12-14}H_{25-29}O[CH_2CH_2O]_5H$ (available from Dow Chemical as TERGITOL™ 15-S-5 Surfactant), EO7 represents $C_{12-14}H_{25-29}O[CH_2CH_2O]_7H$ (available from Dow Chemical as TERGITOL™ 15-S-7 Surfactant), EO9 represents $C_{12-14}H_{25-29}O[CH_2CH_2O]_9H$ (available from Dow Chemical as TERGITOL™ 15-S-9 Surfactant), EO12 represents $C_{12-14}H_{25-29}O[CH_2CH_2O]_{12}H$ (available from Dow Chemical as TERGITOL™ 15-S-12 Surfactant), EO15 represents $C_{12-14}H_{25-29}O[CH_2CH_2O]_{15}H$ (available from Dow Chemical as TERGITOL™ 15-S-15 Surfactant) and EO20 represents $C_{12-14}H_{25-29}O[CH_2CH_2O]_{20}H$ (available from Dow Chemical as TERGITOL™ 15-S-20 Surfactant).

Table 1 provides Examples 1-10 of the detergent which incorporates EO5 as the liquid surfactant with different solid surfactants.

TABLE 1

| Ex. | Liquid Surfactant Type | Liquid Surfactant (wt %) | Liquid Surfactant Pour Point (° C.) | Solid Surfactant Type | Solid Surfactant (wt %) | Solid Surfactant Pour Point (° C.) | PEG (wt %) | Avg. Firmness (g) |
|---|---|---|---|---|---|---|---|---|
| 1 | EO5 | 0 | −25 | EO12 | 80 | 23 | 20 | 276 |
| 2 | EO5 | 20 | −25 | EO12 | 60 | 23 | 20 | 266 |
| 3 | EO5 | 40 | −25 | EO12 | 40 | 23 | 20 | 335 |
| 4 | EO5 | 60 | −25 | EO12 | 20 | 23 | 20 | 244 |
| 5 | EO5 | 80 | −25 | EO12 | 0 | 23 | 20 | 234 |
| 6 | EO5 | 0 | −25 | EO15 | 80 | 29 | 20 | 451 |
| 7 | EO5 | 20 | −25 | EO15 | 60 | 29 | 20 | 205 |
| 8 | EO5 | 40 | −25 | EO15 | 40 | 29 | 20 | 351 |
| 9 | EO5 | 60 | −25 | EO15 | 20 | 29 | 20 | 421 |
| 10 | EO5 | 80 | −25 | EO15 | 0 | 29 | 20 | 234 |

As can be seen from the firmness data of Examples 1-10, the firmness of the detergent displays a dependency on the weight percent of the liquid surfactant present. At the ends of the composition space, Examples 1, 5, 6 and 10 exhibit the expected behavior of decreasing firmness with increasing weight percentage of liquid surfactant. However, when the firmness of Examples 1-5 and 6-10 are examined with respect to the changing weight percentage of liquid surfactant, unexpected results are evident. As can be seen across both sets of Examples, the firmness measurements form a "curve" in that the firmness initially decreases with the addition of liquid surfactant, then surprisingly increases with increasing liquid surfactant weight percentage until a maximum or "peak" firmness is reached. After peak firmness, the firmness of the detergent decreases with increasing liquid surfactant weight ratio and weight percentage. The maximum firmness of samples 1-5 is reached at approximately the 40 wt % liquid to solid surfactant ratio at 335 g. Similarly to Examples 1-5, Examples 6-10 exhibit an increase in the firmness of the detergent with an increase in liquid surfactant concentration with a peak firmness being reached at 60 wt % liquid surfactant with a firmness of 421 g. Without being bound by theory, it is believed that the difference in solid surfactant of examples 6-10 has provided for greater stabilization of the liquid surfactant within the detergent and "shifted" the firmness curve to higher weight percentages.

Table 2 provides Examples 11-20 of the detergent which incorporate EO7 as the liquid surfactant with different solid surfactants.

TABLE 2

| Ex. | Liquid Surfactant Type | Liquid Surfactant (wt %) | Liquid Surfactant Pour Point (° C.) | Solid Surfactant Type | Solid Surfactant (wt %) | Solid Surfactant Pour Point (° C.) | PEG-8000 (wt %) | Avg. Firmness (g) |
|---|---|---|---|---|---|---|---|---|
| 11 | EO7 | 0 | 1 | EO12 | 80 | 23 | 20 | 276 |
| 12 | EO7 | 20 | 1 | EO12 | 60 | 23 | 20 | 117 |
| 13 | EO7 | 40 | 1 | EO12 | 40 | 23 | 20 | 286 |
| 14 | EO7 | 60 | 1 | EO12 | 20 | 23 | 20 | 255 |
| 15 | EO7 | 80 | 1 | EO12 | 0 | 23 | 20 | 272 |
| 16 | EO7 | 0 | 1 | EO15 | 80 | 29 | 20 | 451 |
| 17 | EO7 | 20 | 1 | EO15 | 60 | 29 | 20 | 404 |
| 18 | EO7 | 40 | 1 | EO15 | 40 | 29 | 20 | 575 |
| 19 | EO7 | 60 | 1 | EO15 | 20 | 29 | 20 | 227 |
| 20 | EO7 | 80 | 1 | EO15 | 0 | 29 | 20 | 272 |

As can be seen from the firmness data of Examples 11-20, the firmness curve is again present with respect to increasing liquid surfactant concentration. The maximum firmness of each set of Examples 11-15 and 16-20 is reached at around 40 wt % liquid surfactant with the firmness decreasing with either increasing or decreasing liquid surfactant concentration. Notably, while the firmness curve of Examples 16-20 was not shifted with respect to Examples 11-15, the EO15 solid surfactant produced a much harder detergent. Without being bound by theory, the lower Pour Point of EO12 and the interaction between EO7 and EO12 are believed to be the contributing factors the firmness values achieved by Examples 11-15.

Table 3 provides Examples 21-35 of the detergent which incorporates $C_{12-14}H_{25-29}O[CH_2CH_2O]_9H$ as the liquid surfactant with different solid surfactants.

TABLE 3

| Ex. | Liquid Surfactant Type | Liquid Surfactant (wt %) | Liquid Surfactant Pour Point (° C.) | Solid Surfactant Type | Solid Surfactant (wt %) | Solid Surfactant Pour Point (° C.) | PEG-8000 (wt %) | Avg. Firmness (g) |
|---|---|---|---|---|---|---|---|---|
| 21 | EO9 | 0 | 9 | EO12 | 80 | 23 | 20 | 276 |
| 22 | EO9 | 20 | 9 | EO12 | 60 | 23 | 20 | 300 |
| 23 | EO9 | 40 | 9 | EO12 | 40 | 23 | 20 | 318 |
| 24 | EO9 | 60 | 9 | EO12 | 20 | 23 | 20 | 569 |
| 25 | EO9 | 80 | 9 | EO12 | 0 | 23 | 20 | 288 |
| 26 | EO9 | 0 | 9 | EO15 | 80 | 29 | 20 | 451 |
| 27 | EO9 | 20 | 9 | EO15 | 60 | 29 | 20 | 361 |
| 28 | EO9 | 40 | 9 | EO15 | 40 | 29 | 20 | 580 |
| 29 | EO9 | 60 | 9 | EO15 | 20 | 29 | 20 | 259 |
| 30 | EO9 | 80 | 9 | EO15 | 0 | 29 | 20 | 288 |
| 31 | EO9 | 0 | 9 | EO20 | 80 | 35 | 20 | 1077 |
| 32 | EO9 | 40 | 9 | EO20 | 40 | 35 | 20 | 228 |

TABLE 3-continued

| Ex. | Liquid Surfactant Type | Liquid Surfactant (wt %) | Liquid Surfactant Pour Point (° C.) | Solid Surfactant Type | Solid Surfactant (wt %) | Solid Surfactant Pour Point (° C.) | PEG-8000 (wt %) | Avg. Firmness (g) |
|---|---|---|---|---|---|---|---|---|
| 33 | EO9 | 50 | 9 | EO20 | 30 | 35 | 20 | 540 |
| 34 | EO9 | 60 | 9 | EO20 | 20 | 35 | 20 | 112 |
| 35 | EO9 | 80 | 9 | EO20 | 0 | 35 | 20 | 288 |

As can be seen from the firmness data of Table 3, use of different solid surfactants with the same liquid surfactant shifts the peak of the firmness curve with respect to weight percentages of liquid surfactant.

Referring now to Tables 1-3, by altering the composition of the liquid surfactant and the solid surfactant, the peak firmness of the resulting detergent may be shifted to a higher or lower weight percentage of the liquid surfactant. Further, altering the composition of the liquid surfactant and the solid surfactant may be utilized to increases or decreases the maximum firmness of the resulting detergent. Generally, higher firmness values of the detergent are obtained through the use of liquid and solid surfactants which have a greater average molar ethoxylate value. The results of Tables 1-3 are unexpected and surprising from a number of perspectives. First, the Examples generally indicate the trend that the addition of the liquid surfactant actually increases the firmness until the peak firmness is reached which is non-intuitive as the incorporation of liquids often decreases solid strength. Second, individual examples (e.g., Example 9) are in fact majority weight percentage liquid surfactant, yet yield the greatest firmness values for that combination of liquid and solid surfactant further reinforcing the surprising results. Third, Example sets 1-5, 11-15, 16-20, 21-25 and 26-30 each have a liquid surfactant containing Example which exhibits a firmness greater than its corresponding liquid surfactant free Example. For instance, Examples 3, 13, 18, 24 and 28 have greater firmness values than Examples 1, 11, 16, 21 and 26 respectively.

What is claimed is:

1. A composition comprising a surfactant blend, comprising:

a polyethylene glycol, wherein the polyethylene glycol has an average molecular weight of from 5,000 g/mol to 9,000 g/mol;

a first ethoxylated alcohol comprising the formula R—O $(EO)_n$—H, where R is an alkyl, alkenyl, aryl, aralkyl, or heterocyclic group having 7-25 carbons, where (EO) is a polyoxyethylene chain and where n is from 5 to 9, wherein the first ethoxylated alcohol has a Pour Point below 23° C.; and a second ethoxylated alcohol comprising the formula R—$O(EO)_n$—H, where R is an alkyl, alkenyl, aryl, aralkyl, or heterocyclic group having 7-25 carbons, where (EO) is a polyoxyethylene chain and where m is from 15 to 20, wherein the second ethoxylated alcohol has a Pour Point at or above 23° C., further wherein the first ethoxylated alcohol is from 20 wt % to 80 wt % of a total weight of the surfactant blend.

2. The composition of any of claim 1, wherein the polyethylene glycol has an average molecular weight of from 7,000 g/mol to 9,000 g/mol.

3. The composition of claim 2, wherein the polyethylene glycol has an average molecular weight of 8,000 g/mol.

4. The composition of claim 1, wherein the polyethylene glycol is from 10 wt % to 50 wt % of the total weight of the surfactant blend.

5. The composition of claim 4, wherein the polyethylene glycol is 20 wt % of the total weight of the surfactant blend.

6. The composition of claim 1, wherein the first ethoxylated alcohol is from 30 wt % to 70 wt % of the total weight of the surfactant blend.

7. The composition of claim 1, wherein the first ethoxylated alcohol is from 40 wt % to 60 wt % of the total weight of the surfactant blend.

8. The composition of claim 1, wherein the Pour Point of the first ethoxylated alcohol is from −25° C. to 22° C.

9. The composition of claim 8, wherein the Pour Point of the second ethoxylated alcohol is from 23° C. to 35° C.

* * * * *